US008052252B2

(12) United States Patent
Temple

(10) Patent No.: US 8,052,252 B2
(45) Date of Patent: Nov. 8, 2011

(54) DROPLET DEPOSITION APPARATUS

(75) Inventor: Stephen Temple, Cambridge (GB)

(73) Assignee: Xaar Technology Limited, Cambridgeshire (GB)

( * ) Notice: Subject to any disclaimer, the term of this patent is extended or adjusted under 35 U.S.C. 154(b) by 737 days.

(21) Appl. No.: 11/915,813

(22) PCT Filed: May 30, 2006

(86) PCT No.: PCT/GB2006/001961

§ 371 (c)(1),
(2), (4) Date: Dec. 31, 2007

(87) PCT Pub. No.: WO2006/129074

PCT Pub. Date: Dec. 7, 2006

(65) Prior Publication Data

US 2008/0192092 A1 Aug. 14, 2008

(51) Int. Cl.
*B41J 2/045* (2006.01)

(52) U.S. Cl. ..... 347/69; 347/68

(58) Field of Classification Search ..... 347/47, 347/68–72

See application file for complete search history.

(56) References Cited

U.S. PATENT DOCUMENTS

| | | | | |
|---|---|---|---|---|
| 4,882,245 | A | 11/1989 | Gelorme et al. | |
| 6,364,466 | B1 * | 4/2002 | Chen et al. | 347/65 |
| 2002/0008741 | A1 | 1/2002 | Temple et al. | |
| 2005/0068374 | A1 * | 3/2005 | Sagara | 347/58 |
| 2005/0221019 | A1 * | 10/2005 | Baik et al. | 427/487 |

FOREIGN PATENT DOCUMENTS

| | | |
|---|---|---|
| EP | 0 522 814 | 1/1993 |
| JP | 5-162312 | 6/1993 |
| JP | 6-344559 | 12/1994 |
| JP | 2001-191540 | 7/2001 |
| WO | WO-96/08375 | 3/1996 |

OTHER PUBLICATIONS

International Preliminary Report on Patentability for Application No. PCT/GB2006/001961, dated Dec. 13, 2007.

* cited by examiner

*Primary Examiner* — Geoffrey Mruk

(74) *Attorney, Agent, or Firm* — Marshall, Gerstein & Borun LLP

(57) ABSTRACT

A component for a printhead is created by forming a PZT wafer forming a region of SU8 photoresist material on one side of the PZT wafer; sawing in a second side of said planar body, opposite said first side, actuator channels to a depth sufficient to expose an area of the photoresist material; forming a nozzle through the layer of photo-resist material in the exposed area such that then nozzle is in communication with the actuator channels. The region of photoresist material may be used to form a nozzle plate using photolithography.

4 Claims, 2 Drawing Sheets

DROPLET DEPOSITION APPARATUS

FIELD OF THE INVENTION

This invention relates to droplet deposition apparatus such as ink jet printheads and more particularly to the formation of nozzles in such droplet deposition apparatus.

RELATED TECHNOLOGY

It is well recognized that the accurate formation of nozzles plays a vital role in determining printhead performance. Usually, nozzles are formed in a nozzle plate, with care then taken to bond the nozzle plate to the body of the printhead. A wide variety of nozzle plate structures have been proposed, employing a broad range of manufacturing processes. In order to be viable on a commercial scale the manufacturing processes must balance the technical advantages of the product with manufacturing costs.

SUMMARY OF THE INVENTION

In one aspect, the present invention provides a method for forming a component for a droplet deposition apparatus, the method comprising the steps of: forming a planar body of a piezoelectric material; forming on a first side of said planar body a region of a second material; forming in a second side of said planar body, opposite said first side, a channel to a depth sufficient to expose an area of said second material; forming a nozzle through said layer of second material in said exposed area such that the nozzle is in communication with said channel.

Advantageously, said second material is a polymer.

Preferably, said region of second material is formed through the deposition of second material in liquid form.

Suitably, the second material is a photo-resist such as SUB.

In a preferred form of the invention, said region of second material is formed at least partly in a recess in the first side of said planar body, said recess being preferably in the form of a trench running in a trench direction.

Preferably, said channel is elongate in a channel direction perpendicular to said trench direction.

In another aspect, the present invention provides a droplet deposition apparatus comprising a planar body of piezoelectric material formed with a trench on a first side thereof, the trench containing a polymeric material, the body having a plurality of channels formed in a second side opposite the first side, each channel exposing an area of said polymeric material; and a nozzle extending through said polymeric material so as to communicate with said channel.

Advantageously, said channels are elongate in a channel direction perpendicular to said trench direction.

Embodiments of the present invention use SU8 or similar fluids in the forming of an integral nozzle plate and inkjet nozzle. The SU-8 is a negative, epoxy-type, near-UV photo-resist (365 nm). Details of the material may be found in U.S. Pat. No. 4,882,245.

The preferred embodiment described below is of a piezoelectric actuator with integrated nozzle plate but the nozzle plate and nozzle might be integrated into another component (etch Si or Ni or S/steel, for example). In one embodiment of the present invention the nozzle plate may be advantageously formed by photo etching using the SU8 as a photo-resist. This component would be attached to an actuator in a later process step. SU8 can be applied in a liquid form and grades are commercially available such that different functions can be supported (e.g. filling, planarisation, etc). A key advantage is that the surface formed by the deposition of a fluid is defect free, as compared to a surface produced by mechanical means. Additionally, damage or contamination caused by transportation and packaging can be significantly reduced by local application.

BRIEF DESCRIPTION OF THE DRAWINGS

The present invention will now be described by way of example with reference to the accompanying drawings, in which.

DETAILED DESCRIPTION

Figure 1:
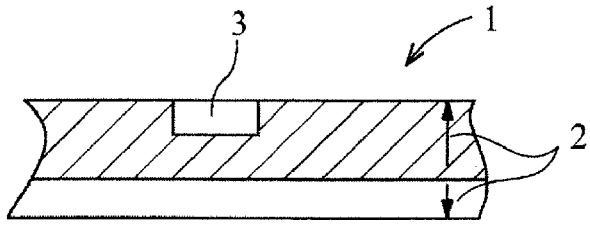
FIG. 1 shows a cross-section through a PZT wafer taken perpendicular to the longitudinal axis of the channel removed.

A PZT wafer 1 (which may be of so-called 'chevron' construction as indicated by arrows 2) is optionally provided with a sawn channel 3 (wafer scale processing step), as shown in FIG. 1 which is a cross-sectional view taken perpendicular to the longitudinal axis of the channel 3.

Figure 2:
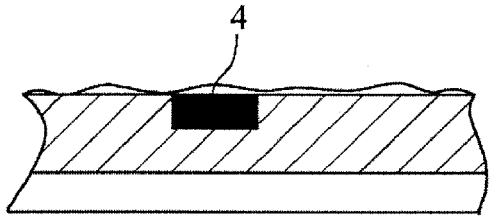
FIG. 2 shows a cross-section through the PZT wafer with the channel filled with SU8 photo-resist.

If formed, the channel is filled with SU8 as shown at 4, e.g. by a dispenser or doctor blade, which is then cured, as shown in FIG. 2.

Figure 3:
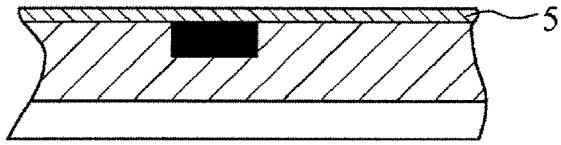
FIG. 3 shows the PZT wafer with an optional layer of photo-resist covering the wafer and channel.

Optionally, a further SU8 layer, 5, is spun onto the top of the wafer and channel, as shown in FIG. 3, and cured. To this end, the SU8 is preferably of the self-levelling type. This additional layer may advantageously be used for photo-etching of a layer of a third material (not shown) in a further embodiment.

Figure 4:
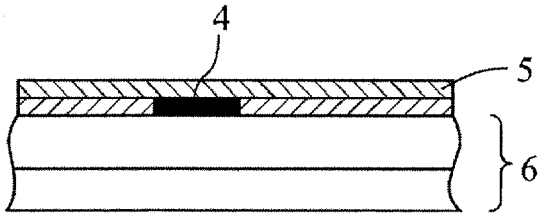
FIG. 4 shows a cross-section of the PZT wafer with the actuator channels formed in the base of the wafer.

Actuator channels are then sawn in the opposite side of the wafer in a direction perpendicular to the channel 3, as shown in FIG. 4. As indicated at 6, the actuator channels are of such depth that they communicate with the SU8 filling 4 of channel 3.

The wafer is subsequently diced, electrodes attached, substrate and ink feed attached, as is known per se.

Figure 5:
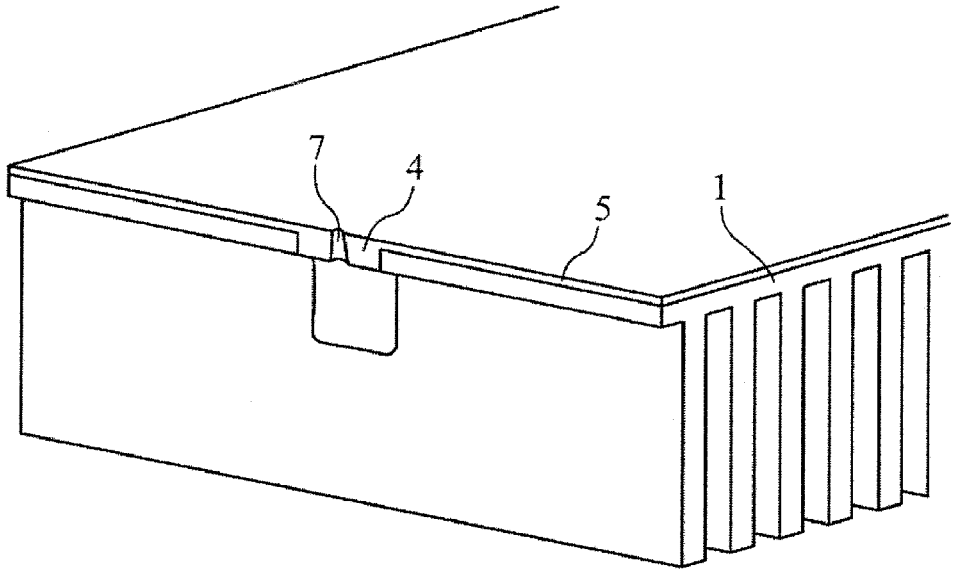
FIG. 5 shows a perspective cross-sectional view of the PZT wafer following the formation of nozzles in the SU8 photo-resist.

Nozzles 7 are then ablated through the SU8 layer 5 and filling 4 so as to communicate with actuator channel 6, as shown in the perspective cross-sectional view, again taken perpendicular to the longitudinal axis of channel 3, of FIG. 5.

It is worthy of note that the SU8 region on the channel side-walls can be used to protect the electrodes on the side walls from laser damage should the SU8 resist the plating method. Ablation protection techniques of the kind disclosed in WO96/08375 may also be used.

In a further embodiment of the invention the channel 3 is not formed; a single layer of SU8 is then spun on top of the wafer. In this embodiment the actuator channel 6 is of sufficient depth to communicate with this layer of SU8.

The invention provides a low cost means of providing a nozzle plate that can easily be added to wafer scale processing. Forming the channel 3 by sawing may be accomplished with high accuracy, reproducibility and speed. Moreover, it employs the PZT to provide mechanical support, thereby reducing component count. Where the SU8 film is spun, this tends to be extremely uniform and defect free which may provide an increase in nozzle jetting performance. SU8 also ablates rapidly reducing manufacturing time and thus cost—and accurately producing a high quality nozzle. SU8 may also be used as a photo-resist to enable the formation of a nozzle plate component.

The invention has been described by way of example only and is applicable to all liquid processable polymeric materials, not just SU8.

The invention claimed is:

1. Droplet deposition apparatus comprising a planar body of piezoelectric material formed with a trench in a first side thereof, the trench containing a polymeric material, the body having a plurality of channels formed in a second side opposite the first side, each channel exposing an area of said polymeric material contained in the trench; and a nozzle extending through said polymeric material in the trench so as to communicate with said channel.

2. Apparatus according to claim 1, wherein said channels are elongate in a channel direction perpendicular to a direction in which the trench extends along the planar body.

3. Apparatus according to claim 2, wherein said polymeric material forms a layer covering at least part of said first side of said planar body of piezoelectric.

4. Apparatus according to claim 1, wherein said polymeric material is a photoresist.

* * * * *

UNITED STATES PATENT AND TRADEMARK OFFICE

CERTIFICATE OF CORRECTION

PATENT NO. : 8,052,252 B2
APPLICATION NO. : 11/915813
DATED : November 8, 2011
INVENTOR(S) : Stephen Temple It is certified that error appears in the above-identified patent and that said Letters Patent is hereby corrected as shown below:

On the Title Page:

Add -- (30) May 28, 2005 (UK) 0510987.1 --.

Signed and Sealed this
Sixth Day of November, 2012

David J. Kappos

David J. Kappos
*Director of the United States Patent and Trademark Office*